US011686030B2

(12) United States Patent
Mashal

(10) Patent No.: US 11,686,030 B2
(45) Date of Patent: Jun. 27, 2023

(54) METHOD FOR DETECTING AND CORRECTING OUT OF BALANCE CONDITIONS IN A WASHING MACHINE APPLIANCE

(71) Applicant: Haier US Appliance Solutions, Inc., Wilmington, DE (US)

(72) Inventor: Khalid Jamal Mashal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 3 days.

(21) Appl. No.: 17/177,737

(22) Filed: Feb. 17, 2021

(65) Prior Publication Data

US 2022/0259787 A1 Aug. 18, 2022

(51) Int. Cl.

| | |
|---|---|
| ***D06F 33/48*** | (2020.01) |
| ***D06F 34/18*** | (2020.01) |
| ***D06F 34/16*** | (2020.01) |
| ***D06F 105/48*** | (2020.01) |
| ***D06F 103/06*** | (2020.01) |
| ***D06F 103/24*** | (2020.01) |
| ***D06F 103/26*** | (2020.01) |
| ***D06F 103/04*** | (2020.01) |

(52) U.S. Cl.

CPC ..... *D06F 33/48* (2020.02); *D06F 34/16* (2020.02); *D06F 34/18* (2020.02); *D06F 2103/04* (2020.02); *D06F 2103/06* (2020.02); *D06F 2103/24* (2020.02); *D06F 2103/26* (2020.02); *D06F 2105/48* (2020.02)

(58) Field of Classification Search

CPC ..... D06F 33/48; D06F 34/16; D06F 34/18; D06F 2103/26

See application file for complete search history.

(56) References Cited

U.S. PATENT DOCUMENTS

| | | | | |
|---|---|---|---|---|
| 2018/0080164 | A1* | 3/2018 | Hoppe | D06F 35/006 |
| 2020/0010999 | A1 | 1/2020 | Seungchul | |
| 2020/0063315 | A1 | 2/2020 | Yoon | |
| 2020/0392660 | A1* | 12/2020 | Park | D06F 23/04 |
| 2021/0025097 | A1* | 1/2021 | Lee | H04N 7/188 |
| 2021/0404103 | A1* | 12/2021 | Park | H04N 5/2257 |

FOREIGN PATENT DOCUMENTS

EP 3309285 A1 4/2018

* cited by examiner

*Primary Examiner* — Spencer E. Bell
(74) *Attorney, Agent, or Firm* — Dority & Manning, P.A.

(57) ABSTRACT

A method of operating a washing appliance includes obtaining images of a wash chamber using a camera assembly operating at a frame rate equivalent to the basket speed. The one or more images are analyzed, e.g., using a machine learning image recognition process, to determine a cloth coverage ratio of the load of clothes in the wash basket. The cloth coverage ratio is compared to a predetermined coverage threshold for reducing out of balance conditions. Specifically, if the cloth coverage area is greater than the threshold, the wash basket may be ramped up to a hold or plaster speed. By contrast, if the cloth coverage area is less than the threshold, the basket speed may be maintained or lowered to permit the clothes to redistribute before ramping to the hold or plaster speed.

15 Claims, 6 Drawing Sheets

METHOD FOR DETECTING AND CORRECTING OUT OF BALANCE CONDITIONS IN A WASHING MACHINE APPLIANCE

FIELD OF THE INVENTION

The present subject matter relates generally washing machine appliances, or more specifically, to systems and methods of using camera assemblies to monitor and correct out of balance conditions within a washing machine appliance.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A wash basket is rotatably mounted within the wash tub and defines a wash chamber for receipt of articles for washing. A drive assembly is coupled to the wash tub and is configured to selectively rotate the wash basket within the wash tub.

Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or an agitation element can rotate at various speeds to agitate or impart motion to articles within the wash chamber. During a spin cycle, the wash basket may be rotated at high speeds, e.g., to wring wash fluid from articles within the wash chamber.

A significant concern during operation of washing machine appliances is out-of-balance conditions within the wash tub. For example, articles and water loaded within a wash basket may not be equally weighted about a central axis of the wash basket and wash tub. Accordingly, when the wash basket rotates, in particular during a spin cycle, the imbalance in clothing weight may cause the wash basket to be out-of-balance within the wash tub, such that the axis of rotation does not align with the axis of the cylindrical wash basket or wash tub. Such out-of-balance issues can cause the wash basket to contact the wash tub during rotation and can further cause movement of the wash tub within the cabinet. Significant movement of the wash tub can, in turn, generate increased noise, vibrations, washer "walking," and/or cause excessive wear and premature failure of appliance components.

Various methods are known for monitoring load balances and preventing out-of-balance scenarios within washing machine appliances. Such monitoring and prevention may be especially important, for instance, during the high-speed rotation of the wash basket, e.g., during a spin cycle. However, such methods typically monitor load balance and detect out-of-balance states during the spin cycle, when the wash basket is already spinning at a high rate of speed. Accordingly, noise, vibration, movement, or damage may occur due to the out-of-balance detection.

Accordingly, improved methods and apparatus for monitoring load balance in washing machine appliances are desired. In particular, methods and apparatus which provide accurate monitoring and detection at earlier times during the wash cycle would be advantageous.

BRIEF DESCRIPTION OF THE INVENTION

Advantages of the invention will be set forth in part in the following description, or may be apparent from the description, or may be learned through practice of the invention.

In one exemplary embodiment, a washing machine appliance is provided including a wash tub positioned within a cabinet, a wash basket rotatably mounted within the wash tub and defining a wash chamber configured for receiving a load of clothes, a motor assembly operably coupled to the wash basket for selectively rotating the wash basket, a camera assembly mounted within the cabinet in view of the wash chamber, and a controller operably coupled to the motor assembly and the camera assembly. The controller is configured to obtain one or more images of the wash chamber using the camera assembly, analyze the one or more images using a machine learning image recognition process to determine a cloth coverage ratio of the load of clothes in the wash basket, compare the cloth coverage ratio to a predetermined coverage threshold, and adjust at least one operating parameter of the washing machine appliance based at least in part on the comparison of the cloth coverage ratio to the predetermined coverage threshold.

In another exemplary embodiment, a method of operating a washing appliance is provided. The washing appliance includes a wash basket rotatably mounted within a wash tub and defining a wash chamber configured for receiving a load of clothes, a motor assembly operably coupled to the wash basket for selectively rotating the wash basket, and a camera assembly mounted within the cabinet in view of the wash chamber. The method includes obtaining one or more images of the wash chamber using the camera assembly, analyzing the one or more images using a machine learning image recognition process to determine a cloth coverage ratio of the load of clothes in the wash basket, comparing the cloth coverage ratio to a predetermined coverage threshold, and adjusting at least one operating parameter of the washing machine appliance based at least in part on the comparison of the cloth coverage ratio to the predetermined coverage threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
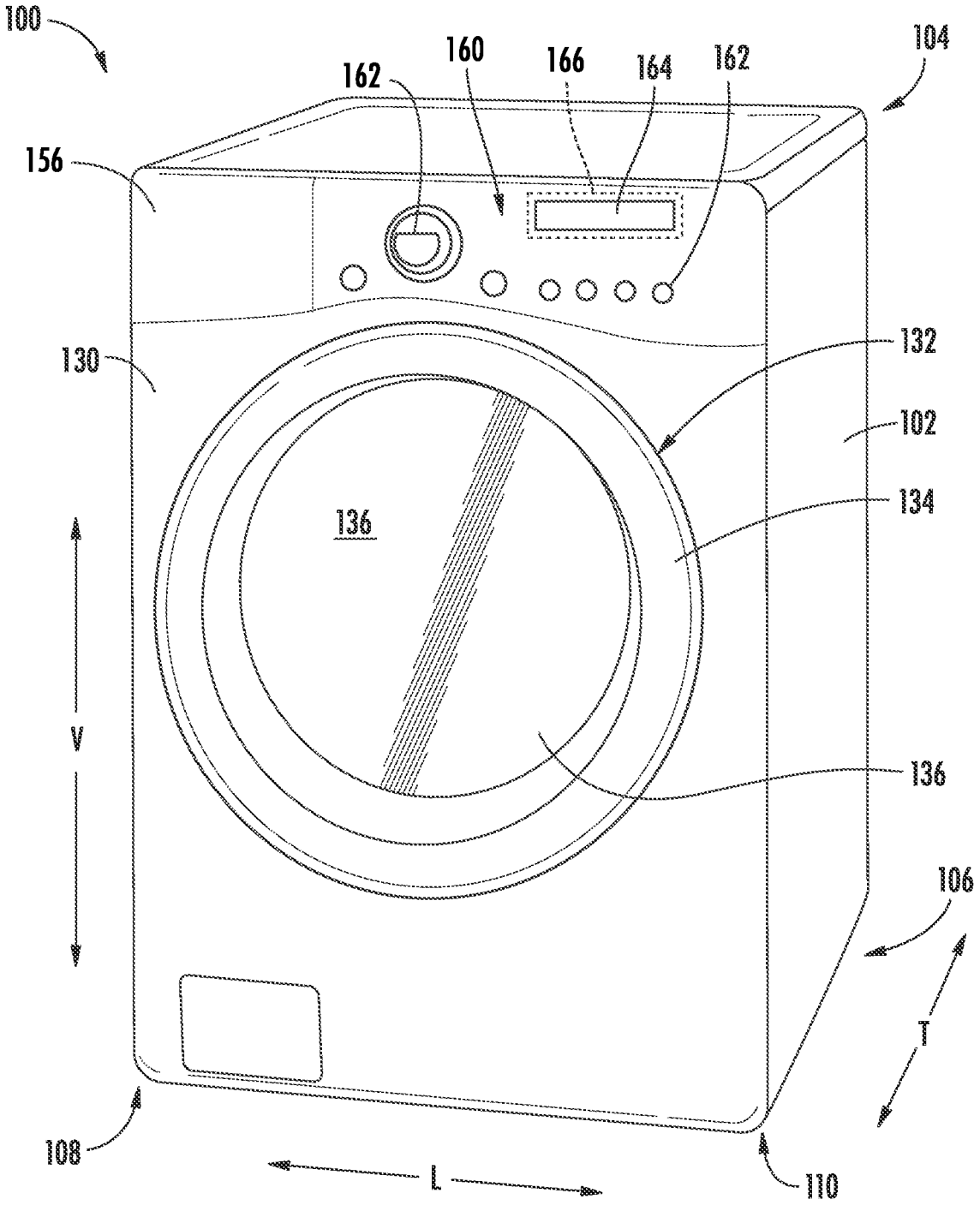
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
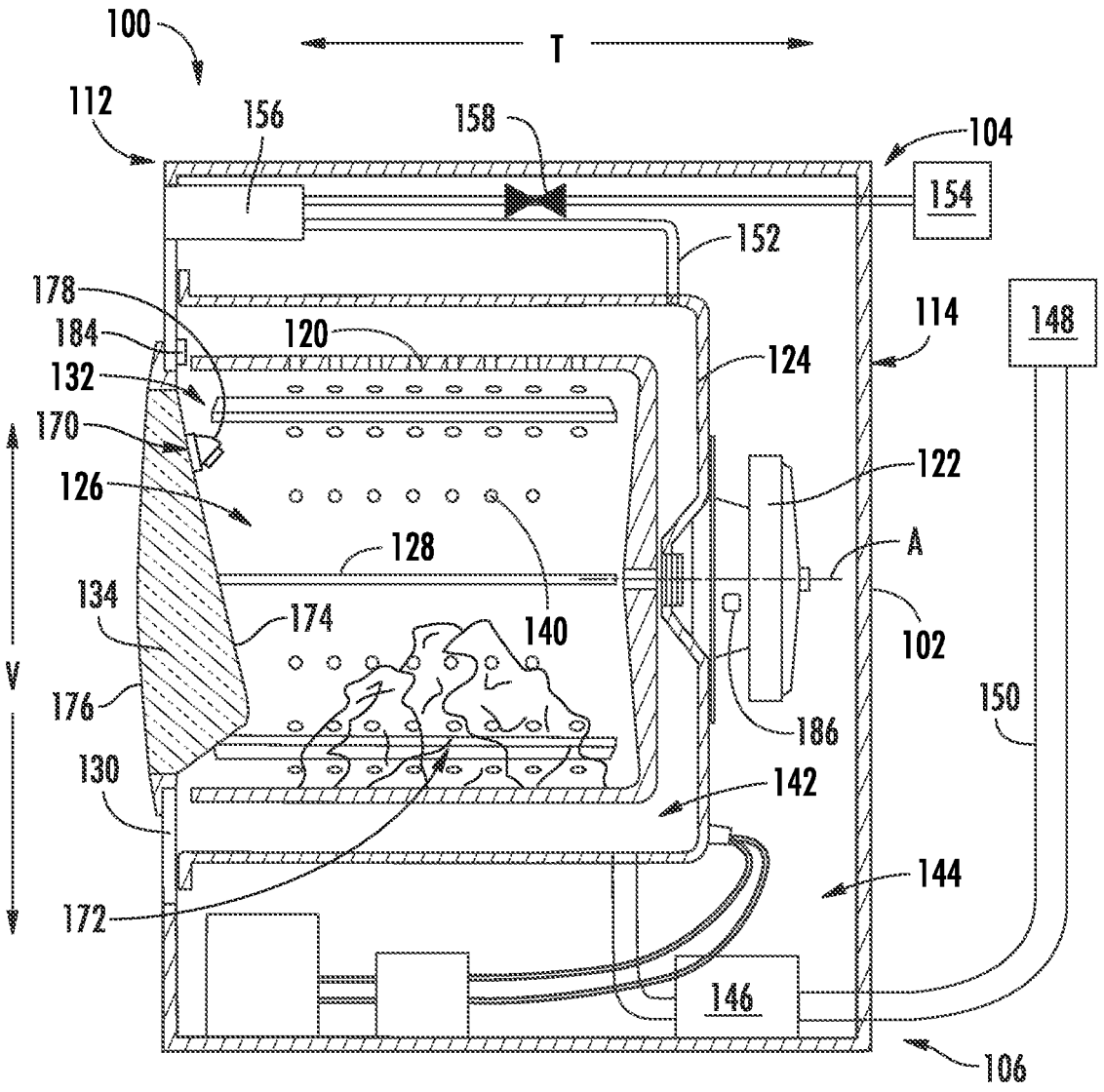
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Figure 3:
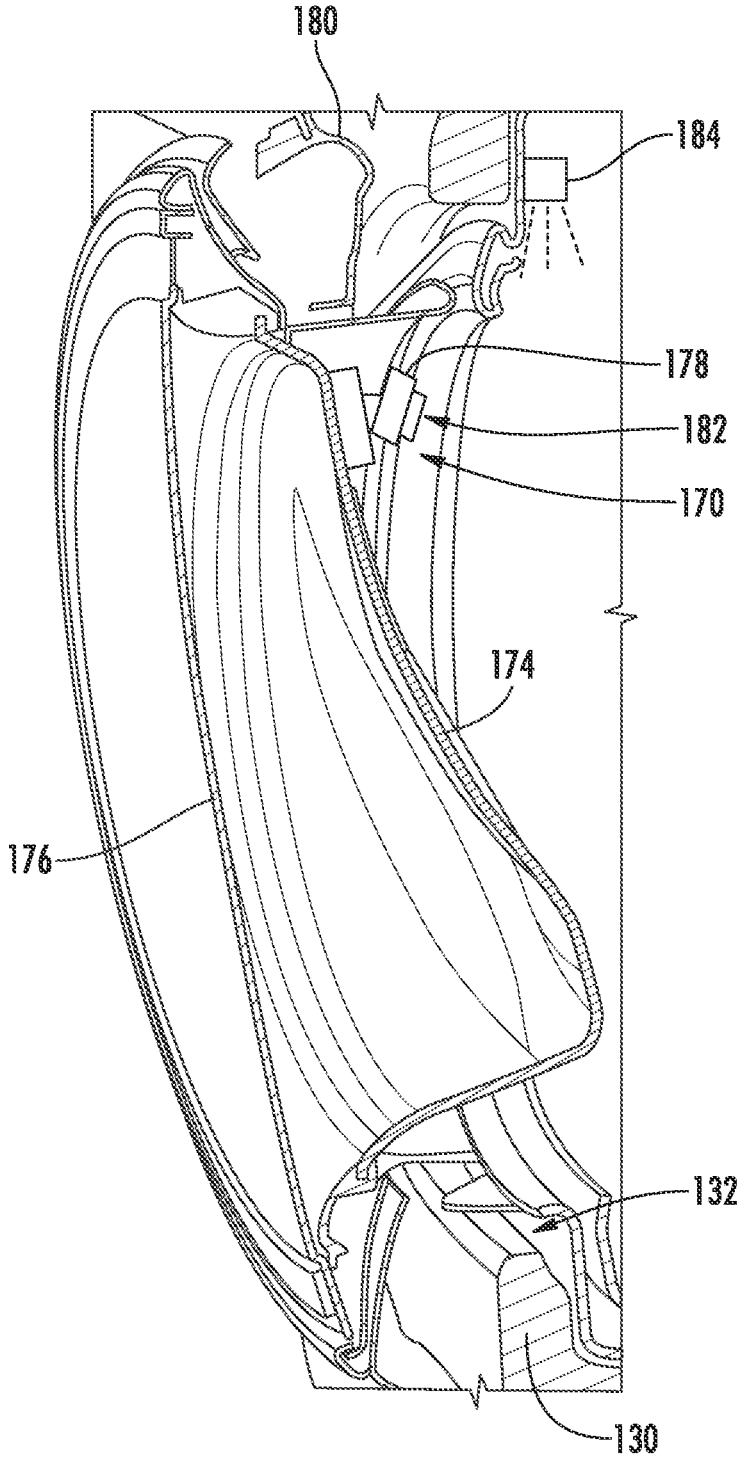
FIG. 3 provides a cross-sectional view of the exemplary washing machine appliance of FIG. 1 with a camera assembly mounted on a door according to an exemplary embodiment of the present subject matter.

Referring now specifically to FIGS. 2 and 3, washing machine appliance 100 may further include a camera assembly 170 that is generally positioned and configured for obtaining images of wash chamber 126 or a load of clothes (e.g., as identified schematically by reference numeral 172) within wash chamber 126 of washing machine appliance 100. Specifically, according to the illustrated embodiment, door 134 of washing machine appliance 100 comprises and inner window 174 that partially defines wash chamber 126 and an outer window 176 that is exposed to the ambient environment. According to the illustrated exemplary embodiment, camera assembly 170 includes a camera 178 that is mounted to inner window 174. Specifically, camera 178 is mounted such that is faces toward a bottom side of wash tub 124. In this manner, camera 178 can take images or video of an inside of wash chamber 126 and remains unobstructed by windows that may obscure or distort such images.

Figure 4:
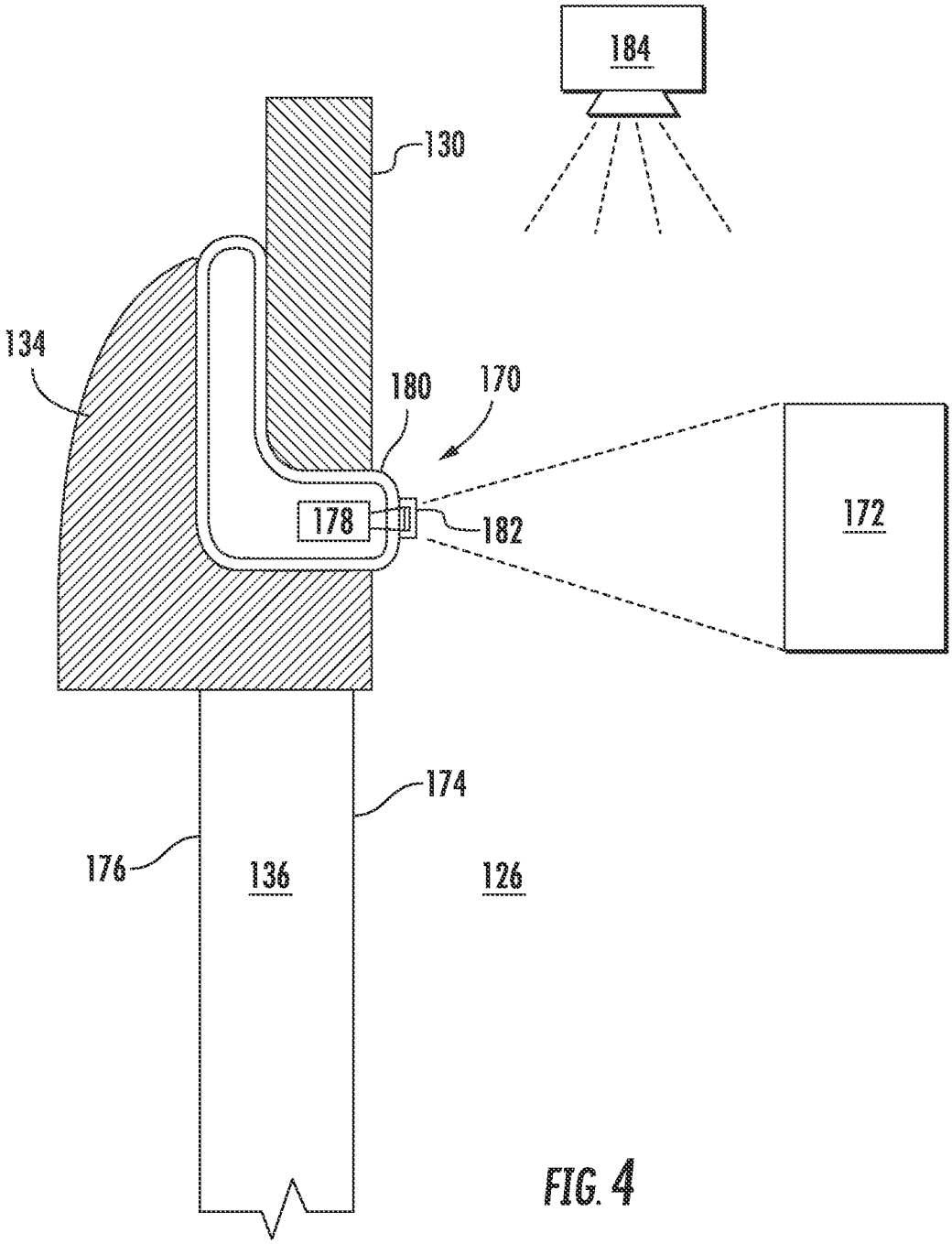
FIG. 4 provides a schematic view of a door and gasket sealed against a cabinet of the exemplary washing machine of FIG. 1, along with a camera mounted within the gasket according to an exemplary embodiment of the present subject matter.

Referring now briefly to FIG. 4, another installation of camera assembly 170 will be described according to an exemplary embodiment of the present subject matter. Due to the similarity between this and other embodiments, like reference numerals may be used to refer to the same or similar features. According to this exemplary embodiment, camera assembly 170 is mounted within a gasket 180 that is positioned between a front panel 130 of cabinet 102 and door 134. Although exemplary camera assemblies 170 are illustrated and described herein, it should be appreciated that according to alternative embodiments, washing machine appliance 100 may include any other camera or system of imaging devices for obtaining images of the load of clothes 172.

It should be appreciated that camera assembly 170 may include any suitable number, type, size, and configuration of camera(s) 178 for obtaining images of wash chamber 126. In general, cameras 178 may include a lens 182 that is constructed from a clear hydrophobic material or which may otherwise be positioned behind a hydrophobic clear lens. So positioned, camera assembly 170 may obtain one or more images or videos of clothes 172 within wash chamber 126, as described in more detail below. Referring still to FIGS. 2 through 4, washing machine appliance 100 may further include a tub light 184 that is positioned within cabinet 102 or wash chamber 126 for selectively illuminating wash chamber 126 and/or the load of clothes 172 positioned therein.

According to exemplary embodiments of the present subject matter, washing machine appliance 100 may further include a basket speed sensor 186 (FIG. 2) that is generally configured for determining a basket speed of wash basket 120. In this regard, for example, basket speed sensor 186 may be an optical, tactile, or electromagnetic speed sensor that measures a motor shaft speed (e.g., such as a tachometer, hall-effect sensor, etc.). According to still other embodiments, basket speeds may be determined by measuring a motor frequency, a back electromotive force (EMF) on motor 122, or a motor shaft speed in any other suitable manner. Accordingly, it should be appreciated that according to exemplary embodiments, a physical basket speed sensor 186 is not needed, as electromotive force and motor frequency may be determined by controller 166 without needing a physical speed sensor. It should be appreciated that other systems and methods for monitoring basket speeds may be used while remaining within the scope of the present subject matter.

Notably, controller 166 of washing machine appliance 100 (or any other suitable dedicated controller) may be communicatively coupled to camera assembly 170, tub light 184, basket speed sensor 186, and other components of washing machine appliance 100. As explained in more detail below, controller 166 may be programmed or configured for obtaining images using camera assembly 170, e.g., in order to detect certain operating conditions and improve the performance of washing machine appliance. In addition, controller 166 may be programmed or configured to perform methods to predict out of balance conditions using images obtained by camera assembly 170. Controller 166 may further implement corrective action early in the cycle, e.g., by redistributing clothes, to reduce out of balance during high-speed spin, reducing overall cycle time, and improving performance of washing machine appliance 100.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, aspects of the present subject matter may be utilized in a combination washer/dryer appliance. Indeed, it should be appreciated that aspects of the present subject matter may further apply to other laundry appliances, such as combination washers/dryers, dryer appliances, etc.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 5:
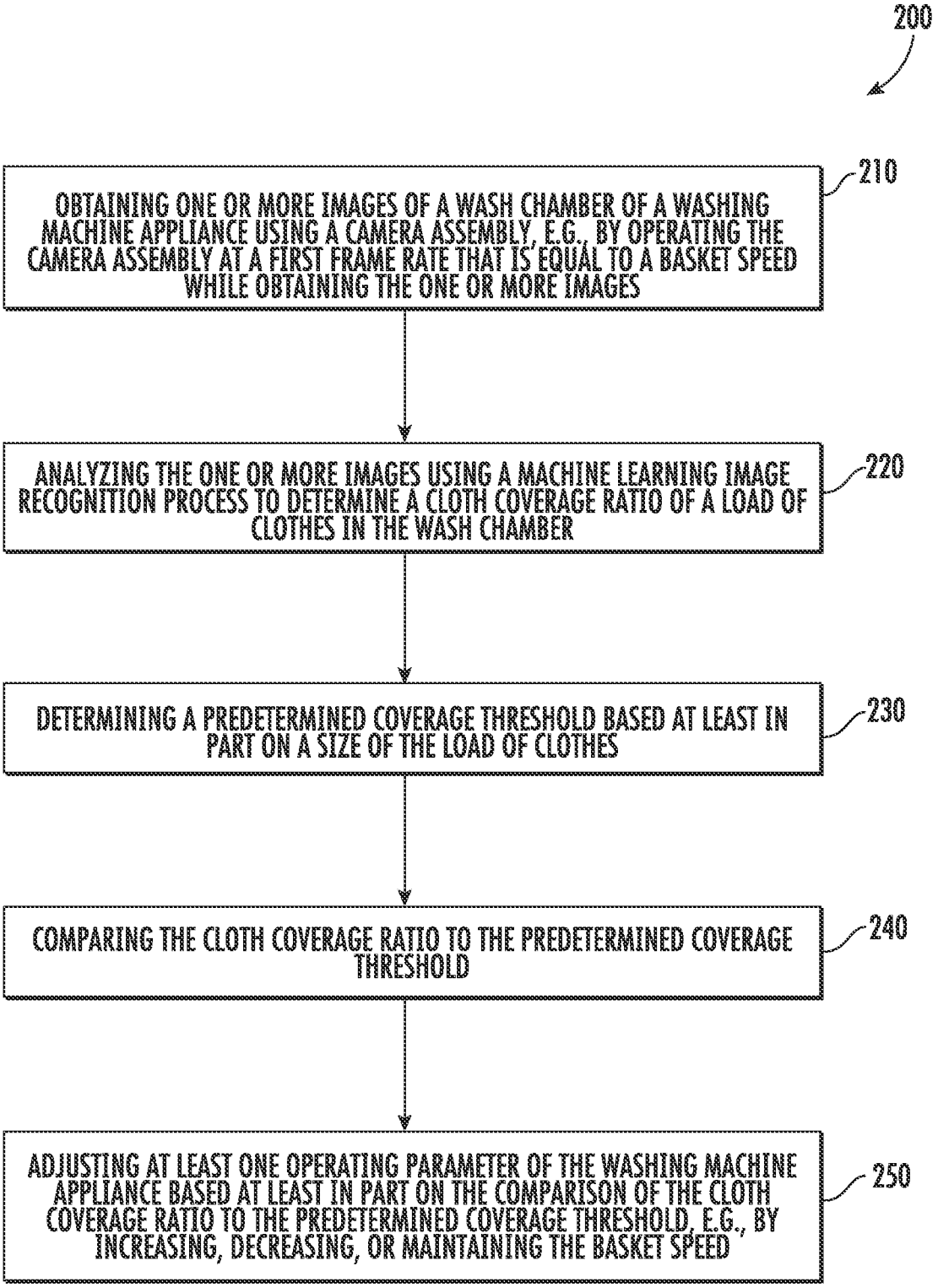
FIG. 5 illustrates a method for operating a washing machine appliance in accordance with one embodiment of the present disclosure.

Referring now to FIG. 5, method 200 includes, at step 210, obtaining one or more images of a wash chamber of a washing machine appliance using a camera assembly. For example, continuing the example from above, camera assembly 170 may capture images of wash chamber 126 of washing machine appliance 100. As explained in more detail below, these images may be used to determine a distribution of clothes 172 within wash chamber 126 in order to predict potential out of balance conditions that would cause undesirable vibrations or other operational issues at high-speed spin, e.g., such as a plaster or hold speed. By identifying an improper distribution of clothes at this early stage, corrective action may be taken with little or no extension of the total spin cycle time.

According to exemplary embodiments of the present subject matter, a frame rate of camera assembly 170 may be set such that it is substantially equivalent to the basket speed (e.g., as determined using basket speed sensor 186 or any other suitable means). As used herein, the term "frame rate" and similar terms are intended generally to refer to the number of images taken by camera assembly 170 within a given time period. For example, the frame rate may be the number of individual frames obtained by camera assembly 170 within a single second, often referred to as frames per second (or "FPS"). Although the discussion herein refers to having a frame rate that is equivalent to the basket speed, it should be appreciated that absolute equivalence is not strictly necessary and that aspects of the present subject matter may be implemented with slight differences between the measured basket speed and the frame rate.

The present disclosure generally refers to maintaining a frame rate that is equivalent to the basket speed. However, it should be appreciated that any suitable conversions as to the measured variables and their frequency of capture may be used according to exemplary embodiments. Indeed, controller 166 and/or camera assembly 170 may generally be configured for making any suitable adjustment to the frame rate of camera assembly 170 such that it corresponds to the basket speed. Notably, when the frame rate and basket speed are synced in this manner, the resulting video or series of images has less distortion or blur and generally provides a better representation or snapshot of the load of clothes 172 within wash chamber 126. For example, this may be due to the fact that each frame captured by camera assembly 170 shows wash basket 120 at the same angular position. However, it should be appreciated that according to alternative embodiments, the images obtained at step 210 may be captured independent of the basket speed. In this regard, while adjusting the frame rate of camera assembly 170 to match the basket speed may improve the clarity of images obtained, aspects of the present subject matter may be used to predict a cloth coverage ratio using images obtained when the frame rate of the camera assembly does not match the basket speed.

Thus, step 210 includes obtaining a series of frames or a video of the load of clothes 172 within wash chamber 126. For example, camera assembly 170 may obtain a video clip of the wash basket while it is rotating at the basket speed and the frame rate of the video clip is taken at the basket speed. Step 210 may include taking a still image from the video clip or otherwise obtaining a still representation or photo from the video clip. It should be appreciated that the images obtained by camera assembly 170 may vary in number, frequency, angle, resolution, detail, etc. in order to improve the clarity of the load of clothes 172. In addition, according to exemplary embodiments, controller 166 may be configured for illuminating the tub using tub light 184 just prior to obtaining images.

Referring still to FIG. 5, method 200 may include, at step 220, analyzing the one or more images using a machine learning image recognition process to determine a cloth coverage ratio of a load of clothes in the wash chamber. It should be appreciated that any suitable image processing or recognition method may be used to analyze the images obtained at step 210 and facilitate determination of the cloth coverage ratio. In addition, it should be appreciated that this image analysis or processing may be performed locally (e.g., by controller 166) or remotely (e.g., by a remote server).

As used herein, the term "cloth coverage ratio" is generally intended to refer to a ratio of the area of a wash basket covered in clothes over a total area of the wash basket (e.g., of an empty basket), or to otherwise represent the distribution or coverage of clothes within a wash basket. For example, the cloth coverage ratio may refer generally to the percentage of clothes 172 that are visible within wash basket 120 relative to the total image area. By contrast, according to alternative embodiments, the cloth coverage ratio may be a ratio of pixels of an image that includes clothes 172 over the total number of pixels in the image or the number of pixels showing wash basket 120. In addition, according to exemplary embodiments, cloth coverage ratio may refer to the distribution of clothes around wash basket 120, such as a quantitative or qualitative measure of how well clothes are spread around a central axis of wash basket 120.

According to exemplary embodiments of the present subject matter, step 220 of analyzing the one or more images may include analyzing the image(s) of the wash chamber using a neural network classification module and/or a machine learning image recognition process. In this regard, for example, controller 166 may be programmed to implement the machine learning image recognition process that includes a neural network trained with a plurality of images of baskets with different cloth coverage ratios. By analyzing the image(s) obtained at step 210 using this machine learning image recognition process, controller 166 may determine or approximate the cloth coverage ratio, e.g., by identifying the trained image that is closest to the obtained image.

As used herein, the terms image recognition process and similar terms may be used generally to refer to any suitable method of observation, analysis, image decomposition, feature extraction, image classification, etc. of one or more images or videos taken within a wash chamber of a washing machine appliance. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by camera assembly 170 and controller 166 may be programmed to perform such processes and take corrective action.

According to an exemplary embodiment, controller may implement a form of image recognition called region based convolutional neural network ("R-CNN") image recognition. Generally speaking, R-CNN may include taking an input image and extracting region proposals that include a potential object, such as a particular garment or region of a load of clothes. In this regard, a "region proposal" may be regions in an image that could belong to a particular object, such as a particular article of clothing or the wash basket. A convolutional neural network is then used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. For example, step 220 may include using Mask R-CNN instead of a regular R-CNN architecture. In this regard, Mask R-CNN is based on Fast R-CNN which is slightly different than R-CNN. For example, R-CNN first applies CNN and then allocates it to zone recommendations on the covn5 property map instead of the initially split into zone recommendations. In addition, according to exemplary embodiments standard CNN may be used to analyze the image determine whether any articles of clothing are present within wash basket 120. In addition, a K-means algorithm may be used. Other image recognition processes are possible and within the scope of the present subject matter.

It should be appreciated that any other suitable image recognition process may be used while remaining within the scope of the present subject matter. For example, step 220 may include using a deep belief network ("DBN") image recognition process. A DBN image recognition process may generally include stacking many individual unsupervised networks that use each network's hidden layer as the input for the next layer. According to still other embodiments, step 220 may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence ("AI") analysis techniques, and combinations of the above described or other known methods may be used while remaining within the scope of the present subject matter.

In addition, according to exemplary embodiments, the image recognition process performed at step 220 may include analyzing the image using an autoencoder neural network process to determine a cloth coverage ratio. In general, the autoencoder neural network may be used to analyze the images obtained at step 210. Moreover, it should be appreciated that other artificial intelligence and machine learning techniques may be used separately or in conjunction with the autoencoder neural network in order to determine a cloth coverage area or ratio from the images obtained at step 210. Specifically, according to an exemplary embodiment, step 210 can use an autoencoder trained on an empty basket and may analyze the obtained image to identify areas in the image where the cloth is present to output a coverage area ratio of that area to total image area.

As used herein, the terms "autoencoder," "neural network process," "reconstruction technique," and the like are generally intended to refer to any artificial intelligence process intended to detect cloth coverage ratio. In this regard, for example, an autoencoder process may be an unsupervised neural network learning technique that implements a bottleneck in the network that compresses knowledge or data with respect to one or more images. In this regard, for example, the one or more images obtained of the wash chamber by the camera assembly may be an input to a neural network structure where the image data is compressed to generate a hidden layer or bottleneck, and is then reconstructed to form an output layer, i.e., the reconstructed image or images. Notably, the bottleneck may act to constrain the information that traverses the full network, forcing a learned compression of the input data.

During such a reconstruction process, the autoencoder neural network may be trained to minimize a reconstruction error. In this regard, the reconstruction error represents the difference between the reconstructed images from the autoencoder neural network and a baseline image, e.g., an image of an empty basket. Notably, the bottleneck or hidden layers of the autoencoder process limit the amount of information that can flow through the network. In this regard, for example, the input data is encoded into a compressed data set, e.g., a compressed image. The autoencoder neural network then decodes the data during the reconstruction process (e.g., to generate a reconstructed image), and because the network is attempting to minimize a reconstruction error during this decoding process, the model can learn the most important attributes of the input data and determine the best means for reconstructing that data into the output from the bottleneck or the encoded state.

Although an exemplary autoencoder process is described herein, it should be appreciated that other variations, processing techniques, artificial intelligence or machine learning models, and other variations may be made to these methods while remaining within the scope of the present subject matter. Indeed, any method of training a neural network by reconstructing an input image to generate an output or reconstructed image that is a close to the input image as possible while passing through some sort of information bottleneck may be used. This autoencoder neural network may be implemented to capture useful information regarding the cloth coverage ratio as determined from images obtained by camera assembly 170.

Step 230 may include determining a predetermined coverage threshold based at least in part on a load size of the load of clothes. In this regard, the predetermined coverage threshold may be set by a user, may be programmed by the manufacturer, or may be determined by algorithm and may relate to a suitable threshold for entering the high-speed spin cycle with minimal risk of high out of balance conditions. In this regard, as will be explained in more detail below, if the cloth coverage ratio exceeds the predetermined coverage threshold, controller 166 may presume that it is safe to enter the high-speed spin cycle. In this cycle, motor 122 will spin wash basket 120 to a very high speed, referred to herein as the plaster speed or hold speed, for a predetermined amount of time in order to extract excess water from clothes 172, e.g., under large centrifugal force. It should be appreciated that the hold speed may be predetermined by controller 166, may be programmed by a manufacturer, may be set by the user, or may be determined in any other suitable manner. Moreover, the predetermined hold speed may vary depending on a variety of factors, such as load size, load type, etc. By contrast, if the cloth coverage ratio (e.g., as determined at step 220) is less than the predetermined coverage threshold (e.g., determined at step 230), controller 166 may determine that it is not safe to enter the high-speed portion of the spin cycle without producing extreme vibrations or out of balance conditions.

It should be appreciated that the predetermined coverage threshold may depend in large part based on a load size, a load type, or other quantitative or qualitative aspects of load of clothes 172. For example, if the load size is small and contains lightweight and delicate garments, the predetermined coverage threshold may be relatively low, since the risk of large out of balance conditions is minimal. By contrast, if the load size is large and contains heavy blankets or cotton towels, the predetermined coverage threshold may be relatively high, such that the cloth coverage area must be relatively large in order to exceed the threshold such that controller 166 will initiate the high-speed spin cycle. Thus, controller 166 may use conventional load size algorithms to determine the load size and the predetermined coverage threshold.

Step 240 may include comparing the cloth coverage ratio to the predetermined coverage threshold. In this regard, this comparison may be used to determine whether the cloth coverage area is greater than or less than the predetermined coverage threshold. Step 250 includes adjusting at least one operating parameter of the washing machine appliance based at least in part on the comparison of the cloth coverage ratio to the predetermined coverage threshold. In this regard, as will be described in more detail below, controller 166 may be programmed for increasing, decreasing, or maintaining the basket speed of wash basket 120 based on the determined cloth coverage ratio and predetermined coverage threshold, in order to detect and rectify out balance conditions.

For example, as described briefly above, the comparison of the cloth coverage ratio and predetermined coverage threshold at step 240 may include a determination that the cloth coverage ratio is greater than the predetermined coverage threshold. Notably, when the cloth coverage ratio exceeds the predetermined coverage threshold (e.g., the minimal desired coverage area for safe high-speed spin operation), controller 166 may know that it is safe to implement the spin cycle with minimal risk of the harmful out of balance conditions. As a result, step 250 of adjusting the at least one operating parameter may include operating the motor assembly to ramp the basket speed of the wash basket up to a hold speed (e.g., a plaster speed) to plaster clothes 172 against wash basket 120 to extract excess water and complete the spin cycle.

By contrast, the comparison of the cloth coverage ratio and predetermined coverage threshold at step 240 may also result in a determination that the cloth coverage ratio is less than the predetermined coverage threshold. In this regard, method 200 may include additional steps in order to rectify the out of balance conditions and improve the cloth coverage ratio. In this regard, for example, controller 166 may operate motor 122 to maintain or decrease the basket speed as needed in order to reshuffle or redistribute clothes 172 within wash chamber 126.

Specifically, once it is determined that the cloth coverage ratio is less than the predetermined coverage threshold, method 200 may include monitoring images obtained by camera assembly 170 to determine whether clothes 172 are still shuffling or redistributing within wash chamber 126. If analysis of these images (e.g., using image analysis methods described herein) results in a determination that clothes are still tumbling or redistributing within wash chamber 126 (e.g., such that the cloth coverage ratio is changing), method 200 may include continuing the rotation of wash basket 120 at the same speed for a fixed amount of time or until the image is showing improved or increased cloth coverage ratio.

By contrast, if it is determined that the cloth coverage ratio is less than the predetermined coverage threshold and subsequent image comparison results in a determination that clothes 172 are not shuffling or redistributing within wash chamber 126 (e.g., such that the cloth coverage ratio is not changing), this may indicate that the clothes are already partially plastered or stuck in position within wash basket 120. As a result, method 200 may include lowering the speed of wash basket 120, e.g., to permit clothes 172 to fall and begin rolling or tumbling within wash basket 120. After the clothes 172 have had an opportunity to redistribute, the process may be continued until the cloth coverage ratio exceeds the predetermined coverage threshold and a full spin cycle may be commenced.

Notably, this process of comparing the cloth coverage ratio to the predetermined coverage threshold, while useful in reducing the likelihood of harmful out of balance conditions while wash basket 120 is spinning at the plaster speed, may be undesirable if run indefinitely. Specifically, if clothes 172 are not redistributing as desired, the coverage area ratio may never reach the predetermined coverage threshold, thus resulting in an endless rebalancing cycle. To prevent this, method 200 may further include initiating a countdown timer at the commencement of the spin cycle and ramping basket speed up to the hold speed regardless of the coverage area ratio after the countdown timer has expired. According to this exemplary embodiment, controller 166 may implement or rely on other out of balance mitigation techniques during high speed spin in order to prevent harmful or damaging operating conditions of washing machine appliance 100.

Figure 6:
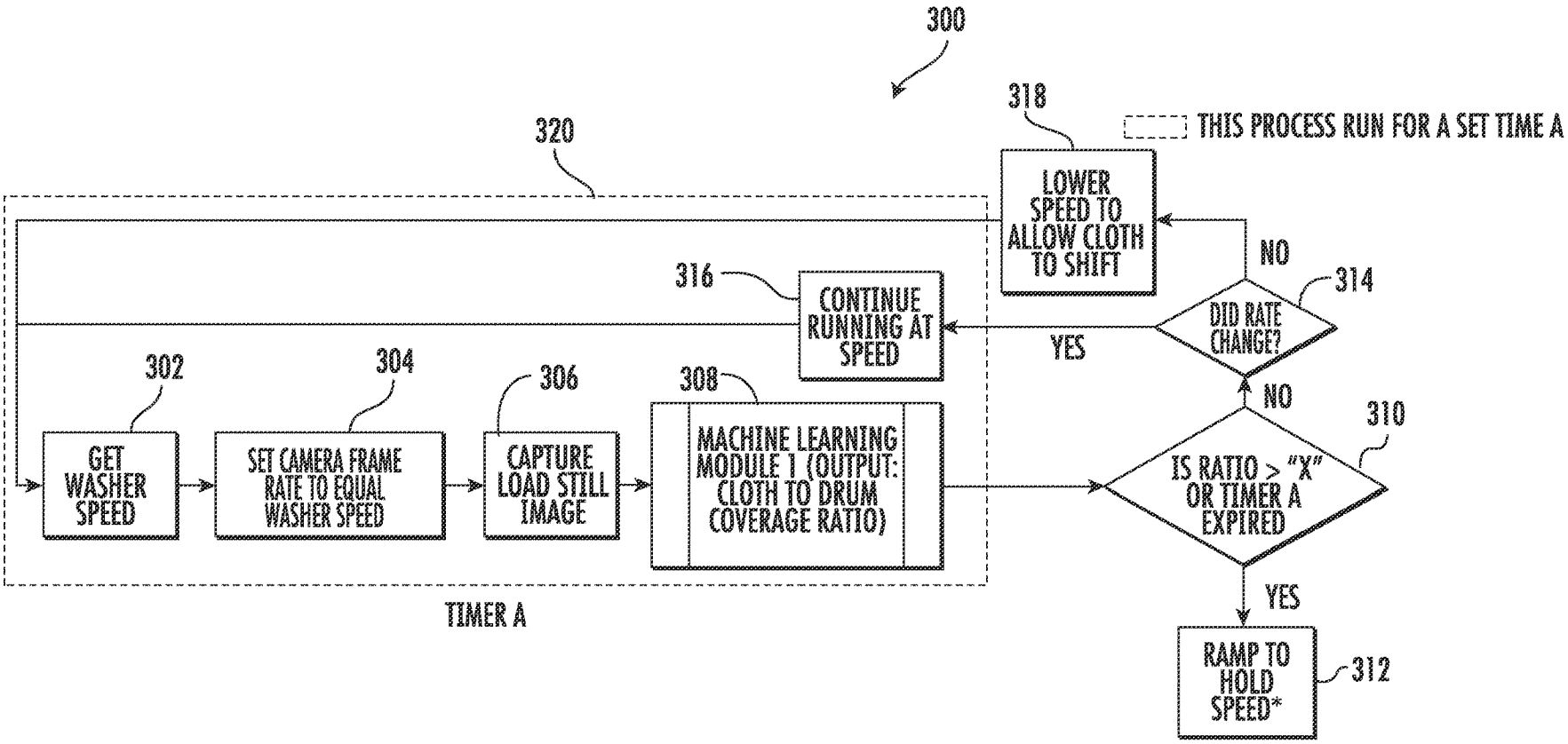
FIG. 6 provides a flow diagram illustrating an exemplary process for implementing a out-of-balance assistance method according to an exemplary embodiment of the present subject matter.

Referring now briefly to FIG. 6, an exemplary flow diagram of out of balance detection, correction, and assistance method 300 that may be implemented by washing machine appliance 100 will be described according to an exemplary embodiment of the present subject matter. According to exemplary embodiments, method 300 may be similar to or interchangeable with method 200 and may be implemented by controller 166 of washing machine appliance 100. As shown, at step 302, controller 166 may first obtain a basket speed of the wash basket. Step 304 may include setting a frame rate of the camera assembly to equal the wash basket speed. In this manner, as described above, camera assembly 170 may obtain improved or clarified images of wash basket 120.

Specifically, at step 306, method 300 includes capturing one or more images of the wash chamber using the camera assembly and step 308 includes implementing a machine learning module to determine a cloth coverage area from the images obtained at step 306. At step 310, the cloth coverage area determined at step 308 is compared to a predetermined coverage threshold (e.g., which may be determined based on the load size, load type, or other quantitative or qualitative parameters associated with the load of clothes). If the cloth coverage ratio is greater than the predetermined coverage threshold, step 312 may include ramping to a hold or plaster speed in order to complete performance of the spin cycle.

By contrast, if the coverage area ratio is less than the predetermined coverage threshold, step 314 may include determining whether the cloth coverage ratio is changing, e.g., whether clothes are still moving around within the wash basket. This may be determined, for example, by comparing sequential images taken within wash basket 120. If the coverage area ratio is determined to be changing at step 314, method 300 may include, at step 316, continuing operation at the same basket speed, e.g., to permit the clothes to redistribute until a desirable cloth coverage ratio is obtained. By contrast, if step 314 determines that the cloth coverage ratio is not changing, this may indicate that clothes are already at least partially plastered against the walls of wash basket 120. As a result, step 318 may include lowering the speed of the wash basket to permit the clothes to shift or redistribute within wash basket. Method 300 may commence at step 302 or 306 and this process may be repeated until the cloth coverage ratio exceeds the predetermined coverage threshold, indicating that is safe to perform the high-speed portion of the spin cycle.

By contrast, according to an exemplary embodiment, it may be desirable to prevent commencement of a spin cycle regardless of the cloth coverage ratio if the predetermined coverage threshold is not reached within a predetermined amount of time. In this regard, for example, method 300 may include initiating a timer as indicated generally by box 320. If the cloth coverage ratio does not exceed the predetermined coverage threshold within this desired amount of time, method 300 may jump directly to step 312, thereby ramping to hold speed and commencing the full spin cycle. In other words, the commencement of the spin cycle (e.g., at step 302) the controller 166 of washing machine appliance 100 may initiate a countdown timer having a predetermined duration, e.g., as selected by the user, programmed by the manufacturer, or determined in any other suitable manner. Controller 166 may be further programmed for determining that the countdown timer has expired and subsequently ramping the basket speed up to the hold speed at expiration of the countdown timer regardless of the cloth coverage ratio.

FIGS. 5 and 6 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable laundry appliance, such as another washing machine appliance or a dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet;

a wash basket rotatably mounted within the wash tub and defining a wash chamber configured for receiving a load of clothes;

a motor assembly operably coupled to the wash basket for selectively rotating the wash basket;

a camera assembly mounted within the cabinet in view of the wash chamber; and a controller operably coupled to the motor assembly and the camera assembly, the controller being configured to:

initiate a countdown timer at the commencement of a spin cycle, the countdown timer having a predetermined duration;

obtain one or more images of the wash chamber using the camera assembly;

analyze the one or more images using a machine learning image recognition process to determine a cloth coverage ratio of the load of clothes in the wash basket;

compare the cloth coverage ratio to a predetermined coverage threshold;

adjust a basket speed of the washing machine appliance based at least in part on the comparison of the cloth coverage ratio to the predetermined coverage threshold;

determine that the countdown timer has expired and operate the motor assembly to ramp the basket speed up to a predetermined hold speed;

determine that the cloth coverage ratio is greater than the predetermined coverage threshold and operate the motor assembly to ramp the basket speed of the wash basket up to the predetermined hold speed; and determine that the cloth coverage ratio is less than the predetermined coverage threshold and operate the motor to maintain or lower the basket speed of the wash basket.

2. The washing machine appliance of claim 1, wherein the one or more images comprises a plurality of images and obtaining the one or more images comprises:

obtaining the basket speed of the wash basket; and operating the camera assembly at a frame rate that is equal to the basket speed while obtaining the plurality of images.

3. The washing machine appliance of claim 1, wherein the one or more images comprises a series of images, and wherein the controller is further configured to:

determine that the coverage area ratio is changing between the series of images; and operate the motor assembly to maintain the basket speed.

4. The washing machine appliance of claim 1, wherein the one or more images comprises a series of images, and wherein the controller is further configured to:

determine that the coverage area ratio is not changing between the series of images; and operate the motor assembly to lower the basket speed.

5. The washing machine appliance of claim 1, wherein the controller is further configured to:

obtain at least one of a load size or a cloth type of the load of clothes; and determine the predetermined coverage threshold based at least in part on at least one of the load size or the cloth type.

6. The washing machine appliance of claim 1, wherein the machine learning image recognition process utilizes an autoencoder neural network process.

7. The washing machine appliance of claim 1, wherein the machine learning image recognition process comprises at least one of a convolution neural network ("CNN"), a region-based convolution neural network ("R-CNN"), a deep belief network ("DBN"), or a deep neural network ("DNN") image recognition process.

8. The washing machine appliance of claim 1, further comprising:

a tub light for illuminating the wash chamber, wherein the controller is further configured to turn on the tub light prior to obtaining the one or more images of the wash chamber.

9. The washing machine appliance of claim 1, comprising:

a door rotatably mounted to the cabinet for providing selective access to the wash chamber; and a gasket positioned between the door and the cabinet, wherein the camera assembly is mounted in the gasket or on an inner surface of the door.

10. A method of operating a washing appliance, the washing appliance comprising a wash basket rotatably mounted within a wash tub and defining a wash chamber configured for receiving a load of clothes, a motor assembly operably coupled to the wash basket for selectively rotating the wash basket, and a camera assembly mounted within the cabinet in view of the wash chamber, the method comprising:

initiating a countdown timer at the commencement of a spin cycle, the countdown timer having a predetermined duration;

obtaining one or more images of the wash chamber using the camera assembly;

analyzing the one or more images using a machine learning image recognition process to determine a cloth coverage ratio of the load of clothes in the wash basket;

comparing the cloth coverage ratio to a predetermined coverage threshold;

adjusting a basket speed of the washing machine appliance based at least in part on the comparison of the cloth coverage ratio to the predetermined coverage threshold;

determining that the countdown timer has expired and operating the motor assembly to ramp the basket speed up to a predetermined hold speed after determining that the countdown timer has expired;

determining that the cloth coverage ratio is greater than the predetermined coverage threshold and operating the motor assembly to ramp the basket speed of the wash basket up to the predetermined hold speed; and determining that the cloth coverage ratio is less than the predetermined coverage threshold and operating the motor to maintain or lower the basket speed of the wash basket.

11. The method of claim 10, wherein the one or more images comprises a plurality of images and obtaining the one or more images comprises:

obtaining the basket speed of the wash basket; and operating the camera assembly at a frame rate that is equal to the basket speed while obtaining the plurality of images.

12. The method of claim 10, wherein the one or more images comprises a series of images, the method further comprising:

determining that the coverage area ratio is changing between the series of images; and operating the motor assembly to maintain the basket speed of the wash basket.

13. The method of claim 10, wherein the one or more images comprises a series of images, the method further comprising:

determining that the coverage area ratio is not changing between the series of images; and operating the motor assembly to lower the basket speed of the wash basket.

14. The method of claim 10, further comprising:

obtaining at least one of a load size or a cloth type of the load of clothes; and determining the predetermined coverage threshold based at least in part on at least one of the load size or the cloth type.

15. The method of claim 10, wherein the machine learning image recognition process comprises at least one of a convolution neural network ("CNN"), a region-based convolution neural network ("R-CNN"), a deep belief network ("DBN"), or a deep neural network ("DNN") image recognition process.

* * * * *